US005365147A

United States Patent [19]

Shinohara et al.

[11] Patent Number: 5,365,147

[45] Date of Patent: Nov. 15, 1994

[54] PLASMA STABILIZING APPARATUS EMPLOYING FEEDBACK CONTROLS

[75] Inventors: Kibatsu Shinohara, Yokohama; Kozo Obara, Kamakura; Tsuku Umezawa, Yokohama, all of Japan

[73] Assignees: Nichimen Kabushiki Kaisha, Osaka; Nihon Kosyuha Kabushiki Kaisha, Yokohama, both of Japan

[21] Appl. No.: 915,809

[22] PCT Filed: Nov. 26, 1991

[86] PCT No.: PCT/JP91/01617

§ 371 Date: Jul. 27, 1992

§ 102(e) Date: Jul. 27, 1992

[87] PCT Pub. No.: WO92/10076

PCT Pub. Date: Jun. 11, 1992

[30] Foreign Application Priority Data

Nov. 28, 1990 [JP] Japan ..... 2-328262

[51] Int. Cl.[5] ..... H01J 7/24

[52] U.S. Cl. ..... 315/111.21; 315/111.51; 118/723 MW

[58] Field of Search ..... 315/111.21, 111.41, 315/111.71, 111.81, 358, 111.51; 118/723 MW, 723 ME, 723 MR

[56] References Cited

U.S. PATENT DOCUMENTS 3,617,804 11/1971 Paine et al. ..... 315/358
4,641,060 2/1987 Dandl ..... 315/111.71
5,170,098 12/1992 Dutton et al. ..... 315/111.41

*Primary Examiner*—Robert J. Pascal
*Assistant Examiner*—Michael B. Shingleton
*Attorney, Agent, or Firm*—Finnegan, Henderson, Farabow, Garrett and Dunner

[57] ABSTRACT

A plasma stabilizing apparatus having circuits for measuring electron temperature and electron density of a plasma using triple probes, a plasma gas pressure control circuit, and a plasma excitation power control circuit, for automatically stabilizing the plasma.

5 Claims, 4 Drawing Sheets

PLASMA STABILIZING APPARATUS EMPLOYING FEEDBACK CONTROLS

BACKGROUND OF THE INVENTION

1. Field of the Invention

The present invention relates generally to a plasma source, and more specifically to an apparatus for generating a plasma and for controlling certain physical conditions of the plasma.

2. Description of Related Art

In recent years, the utility of plasma has expanded continually. In particular, in the field of production facilities for integrated circuits (IC), a stable plasma source is in demand.

In the conventional high frequency plasma apparatus, adjustment of high frequency or microwave power and gas pressure has been done manually with the consequence that it was not possible to follow automatically any fluctuations in the plasma conditions.

SUMMARY OF THE INVENTION

It is an object of the present invention to provide a device for generating a stable plasma.

The present invention is directed to a plasma stabilizer having measuring circuits for measuring electron temperature and electron density of the plasma means of the triple probe; a gas pressure control circuit for controlling the plasma gas pressure with an output signal of the measured electron temperature; an electric power control circuit for controlling a plasma excitation power with a measured output signal of the electron density; and insulated coupling elements which connect the measuring circuit, the gas pressure control circuit, and the power control circuit, thereby automatically generating a stabilized plasma by controlling at least one of the plasma gas pressure and the plasma excitation power.

DESCRIPTION OF THE PREFERRED EMBODIMENTS

Figure 1:
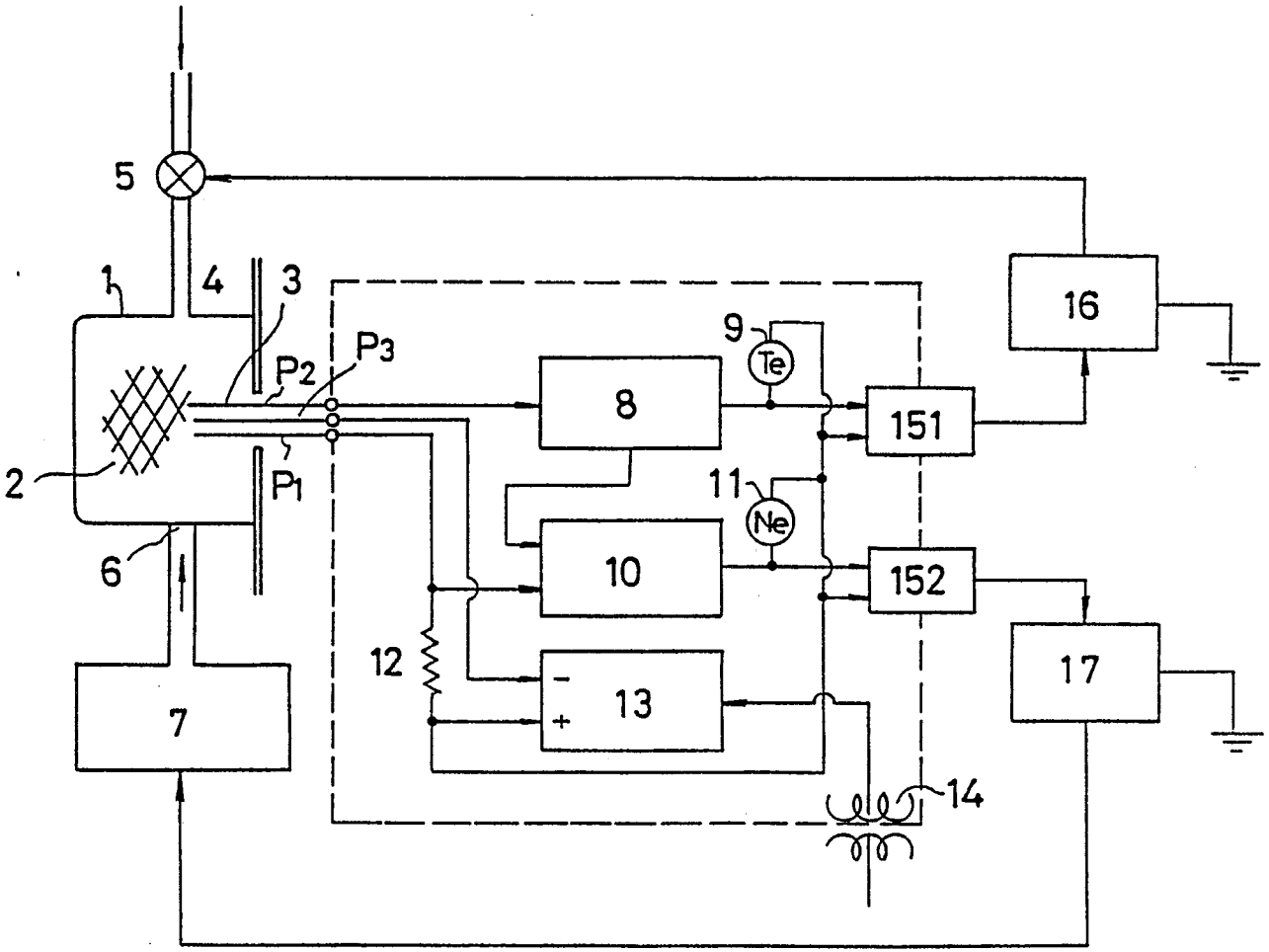
FIG. 1 is a system diagram of one embodiment of the present invention.

The present invention is to provide a plasma stabilizer which is capable of generating stabilized plasma by first displaying directly on an indicator electron temperature and electron density of the plasma using the triple-probe method, and then, using these outputs, the high frequency or microwave power quantity and the gas pressure are controlled, either independently or simultaneously.

In this case, the electron temperature and the electron density from the measuring circuits must be taken out as voltage-to-ground outputs, since these circuits are floating from the standpoint of direct current. With this control voltage outputs, the high frequency or microwave power and the gas pressure are controlled, thereby stabilizing plasma flame.

In case no insulated coupling element is used, the voltage-to-ground which corresponds to the measured output signals of the electron temperature and the electron density are taken out of the abovementioned measuring circuit, with which the gas pressure control circuit and the electronic control circuit may be regulated.

Since the output from the plasma characteristic detecting circuit by the triple probe method is floating from the standpoint of direct current, it is necessary for taking the signals outside to insulatingly connect the circuit in the direct current manner. The preferred embodiments of the present invention transmit control signals to an external circuit by use of the insulated coupling elements such as an isolation amplifier, a voltage/frequency conversion circuit, a photo-isolator, and so forth, even if they are insulated from the standpoint of direct current; and a system of taking out voltages-to-ground which correspond to those output voltages by means of electronic circuit. With these systems, an output signal of the electron temperature Te is introduced into a gas pressure control circuit to control the gas pressure, and a high frequency or microwave output power is controlled with an output signal of the electron density Ne, thereby automatically rendering the plasma flame to be stable.

The electron density in the plasma is determined by a difference between the number of electrons to be generated by ionization in a unit time and the number of electrons to be extinguished by recombination. In an ordinary plasma region where the electron energy is relatively low, ionization probability augments with increase in the electron energy, i.e., increase in high frequency or microwave excitation power to be imparted, while the recombination coefficient decreases, with the consequence that the electron density Ne increases.

While electrons gain kinetic energy by the high frequency power excitation, they lose energy by their collision with atoms or molecules, a difference between the energy gain and the energy loss in a unit time determining the electron temperature Te.

These electron density Ne and electron temperature Te are both varied with the high frequency or microwave excitation power as applied and the gas pressure. According to experiments conducted by direct reading of the electron density Ne and the electron temperature Te by the triple probe method, the electron density Ne indicated a large increase with increase in the excitation power, but the electron temperature Te indicated just a slight increase. Also, the electron temperature Te indicated a remarkable decrease with increase in the gas pressure, while the electron density Ne showed a very small variation.

Therefore, in the preferred embodiments of the present invention, a voltage corresponding to an indicated voltage output of the electron temperature Te was introduced into a gas control circuit to control the gas pressure by adjustment of an electromagnetic valve, while a voltage corresponding to a voltage output of the electron density Ne was introduced into a power control circuit to control the high frequency or microwave output power, thereby stabilizing the plasma flame.

Although the automatic control by the gas pressure and the automatic control by the high frequency or microwave power show their effectiveness, even if any one of them is practised independently of the other, a more remarkable increase in stabilizing effect can be obtained when both are carried out simultaneously.

Figure 3:
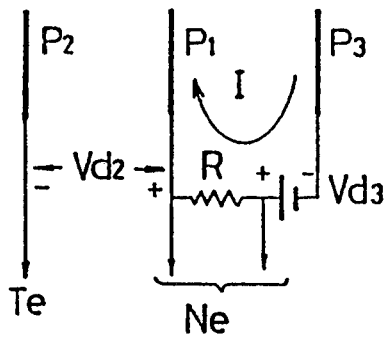
FIG. 3 is an explanatory diagram for the principle of the triple probe method.

The principle of, and measurement by, the triple probe method have already been explained in various literatures in this field. To summarize, for the direct reading of Ne and Te, when three probes $P_1$, $P_2$, and $P_3$, each having an equal surface area, are inserted into the plasma in a mutually adjacent relationship, and a voltmeter (a Te measuring circuit) having high input impedance is connected to a load of the probe $P_2$ as in FIG. 3 to render the probe to be in a floating condition, no electric current flows through the probe $P_2$. When, at this time, the electric charge of the electron is expressed by "e", Boltzman's constant by "k", a difference voltage to be generated across the probes $P_1$ and $P_2$ by $V_{d2}$, and a constant voltage to be imparted to the probe $P_3$ by $V_{d3}$, so as to find a voltage drop of a current I flowing from the probe $P_3$ to $P_1$ to appear at both ends of a low resistor R, the relationship will be expressed by the following equation.

$$\{1-exp\,(-\phi_{d2})\}/\{1-exp\,(-\phi_{d3})\}=\tfrac{1}{2}$$

In the above equation, $$\phi_{d2}=e\,V_{d2}/kTe$$

$$\phi_{d3}=e\,V_{d3}/kTe.$$

Accordingly, if $V_{d3}$ is assumed to be a constant value, Te can be obtained by measurement of the value $V_{d3}$.

This equation signifies that the ion current within the measuring range has small variations, although the ion current flowing in and through a cylindrical probe in the collisionless plasma increases theoretically in proportion to a ($\frac{1}{2}$) power of the probing voltage. Hence, the ion current $I_i(V)$ at a voltage V can be expressed as follows, using a constant $\beta$ and with the ion current $I_i(V_f)$ at a floating voltage $V_f$ being made a reference.

$$\{I_i(V)\}^2=\{I_i(V_f)\}^2\,(1+\beta\Delta V)$$

Figure 4:
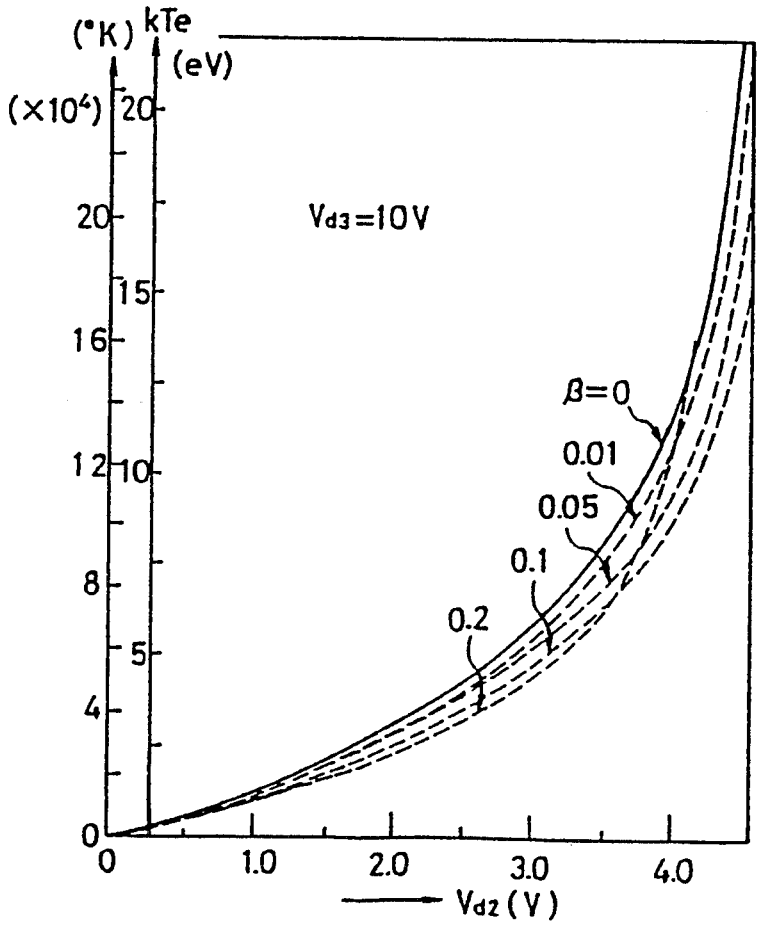
FIG. 4 is a characteristic diagram of voltage $V_{d2}$ versus electron temperature Te.

Provided that the ion current varies in such manner, the electron temperature Te with respect to various constants $\beta$ will be as shown in FIG. 4, when $V_{d3}=10$ v constant.

According to experiments, it was found that, from the general plasma measurement, when $\beta=1.05$, an error of Te stayed within a few per cents.

As to the electron density Ne, the following relationships have been made known:

$$Ne=(M^{\frac{1}{2}}/S)\cdot I\cdot f_1(V_{d2})$$

$$f_1\,(V_{d2})=1.05\times10^9\times(Te)^{-\frac{1}{2}}/\}exp(-\phi_{d2})-1\}.$$

The units of measurement used are as follows: Ne ($cm^{-3}$); the surface area of the probe ($mm^2$); I ($\mu$ A); Te (eV); M (atomic quantity or molecular quantity of ion); and $V_{d2}$ (V). In the above two equations, if the values M and S are given, the electron density Ne can be obtained from the probing current I, Te, and $V_{d2}$, whereby the value of this electron density can be read directly on the output gauge.

An output voltage corresponding to the electron temperature Te as found on the basis of the abovementioned principle is indicated on the gauge and, at the same time, the direct current is interrupted by means of the insulated coupling element, or an output voltage corresponding to the earthing point is found from the electronic circuit, the output voltage of which is amplified by the gas control circuit to control the electromagnetic valve and to increase or decrease the gas pressure. In more detail, when the electron temperature Te is too high, the gas pressure is increased to lower Te, and, on the contrary, when Te is too low, the gas pressure is reduced to elevate the Te.

On the other hand, the output voltage of the electron density Ne indicated on the gauge is also found as a voltage corresponding to an output with respect to the earthing point, the output of which is introduced into the excitation power control circuit to increase or decrease the output power from the high frequency or microwave generating source, thereby controlling the plasma excitation power. That is to say, if the electron density Ne is excessively high, the excitation power is lowered to reduce the density, and, on the contrary, if it is excessively small, the excitation power is increased to augment the electron density. In this way, plasma flame can be automatically maintained in a stabilized condition.

In the drawing, a numeral 1 refers to a plasma chamber: a numeral 2 refers to a plasma flame; a numeral 3 refers to probes; a reference 4 designates a gas inlet port; a numeral 5 denotes an electromagnetic valve: a reference numeral 6 designates an excitation power coupling port; a numeral 7 refers to a high frequency or microwave power source; a numeral 8 represents a Te measuring circuit; a numeral 9 refers to a Te output indicator; 10 designates an Ne measuring circuit; 11 denotes an Ne output indicator; 12 refers to a micro-resistor; 13 denotes a $V_{d3}$ constant voltage power source: 14 represents an insulated transformer: 151 and 152 refer to insulated amplifiers; 16 denotes a gas control circuit; 17 indicates an excitation power control circuit; 191, 192 and 193 designate resistors for preventing short-circuit; 201, 202 and 203 denote input terminal resistors: 211, 212, 213 and 241, 242 refer to differential amplifiers: 221, 222, 223, 231, 232, and 233 designate inverters.

BEST MODE TO PRACTICE THE INVENTION

In the following, the plasma stabilizing device according to the present invention will be described in reference to the accompanying drawing.

FIG. 1 shows a system diagram for one embodiment of the present invention. A specimen gas is fed into the plasma chamber 1 through the electromagnetic valve 5, while microwave power is introduced thereinto through the coupling port 6 to thereby generate the plasma 2. Within this plasma, there are inserted three probes, each having an equal surface area. As shown in the explanatory diagram of FIG. 3 for the principle of the triple probe method, the probe $P_2$ indicates a value of Te on the indicator gauge 9 after it has been amplified in the electron temperature Te measuring circuit 8. To the probe $P_3$, there is applied a negative voltage of 10 volts from the $V_{d3}$ constant voltage source 13, and a voltage drop to be generated in the micro-resistor 12 of 1 ohm with a current I flowing from the probe $P_3$ to the probe $P_1$ is calculated in the Ne measuring circuit 10 together with the output voltage of Te to determine a voltage corresponding to the electron density Ne, the quantity of Ne being indicated on the indicator gauge 11.

Since the output voltage from the Te measuring circuit 8 has to be floated in the form of a direct current, use is made of the insulated amplifier 151 as the insulated coupling element, a control voltage being applied to the gas control circuit 16 in the subsequent stage to adjust the electromagnetic valve 5, thereby controlling pressure of the specimen gas.

Figure 5:
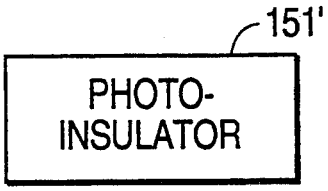
FIG. 5 is a diagram showing an alternative to element 151 shown in FIG. 1.
Figure 6:
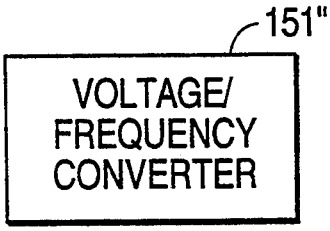
FIG. 6 is another diagram showing another alternative to element 151 shown in FIG. 1.

As the insulated coupling element, use can be made of, besides the insulated amplifier 151, an insulating method using a photo-insulator 151' as shown in FIG. 5, or a voltage/frequency converter 151" as shown in FIG. 6; or a method, in which a direct current voltage is coupled with an alternating current by means of an insulated transformer after the conversion, followed by returning it to the direct current, or other methods.

Use was also made of the insulated amplifier 152 as the insulated coupling element to impart the output voltage from the Ne measuring circuit 10 to the excitation power control circuit 17, wherein the power of the microwave power source 7 of 2.45 GHz was adjusted to control the excitation power to be imparted to the plasma, thereby stabilizing the plasma flame 2. The alternating current power necessary for these control operations is obtained by way of the insulated transformer 14.

Figure 2:
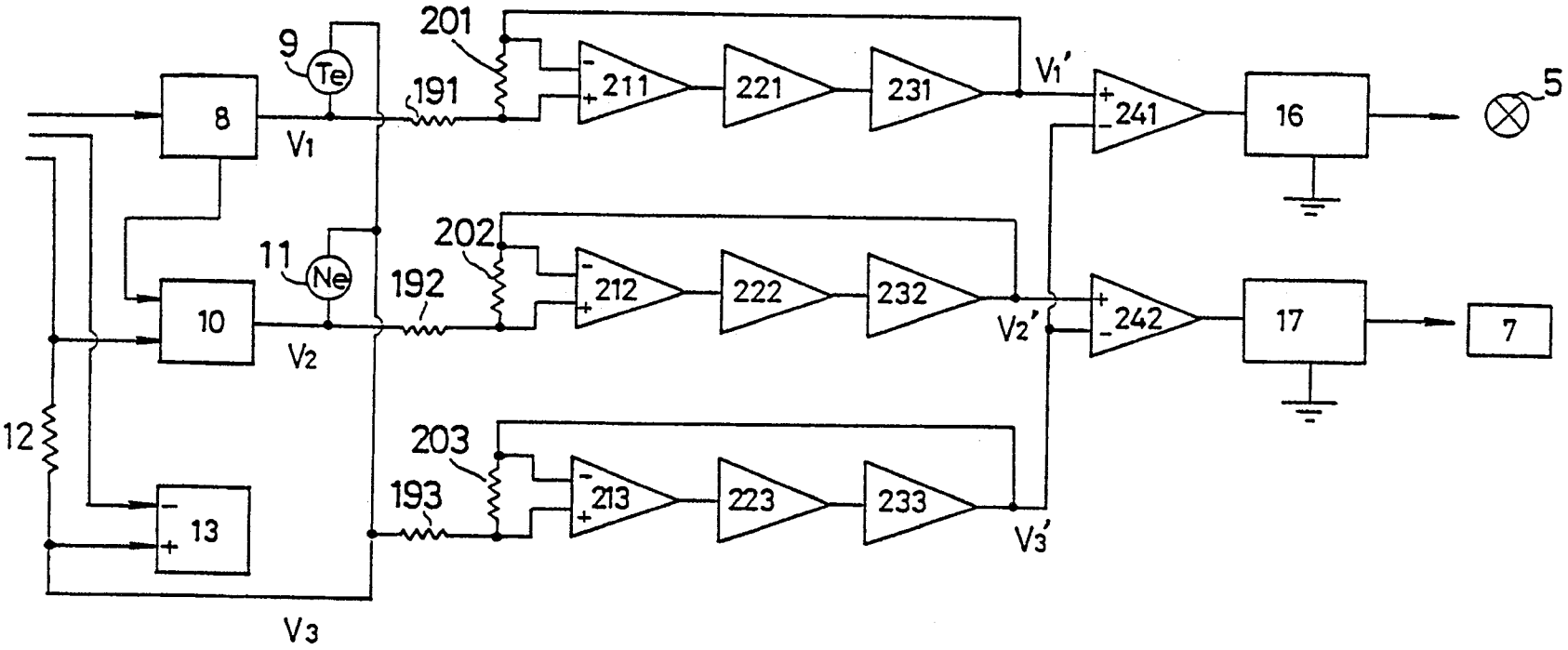
FIG. 2 is a system diagram of another embodiment thereof.

As another embodiment of the present invention, FIG. 2 illustrates an extracted part which replaces the insulated coupling element shown in FIG. 1. When the output potential of the Te measuring circuit 8 is designated as V1, the output potential of the Ne measuring circuit 10 is designated as V2, and the potential at the positive (+) terminal of the $V_{d3}$ constant voltage source is designated as V3, the Te output indicator fluctuates in proportion to a voltage difference of V1 and V3, and the Ne output indicator fluctuates in proportion to a voltage difference of V2 and V3.

Since the potential V1 is connected to the positive input terminal of the differential amplifier 211, the output of which is amplified by the two-stage inverters 221, 231, and the outputs from these inverters are fed back to the negative input terminal of the differential amplifier 211, an equilibrated state is brought in when the output potential V1' of the inverter 231 becomes equal to the output potential V1.

The potentials at V2 and V3 are also amplified by those differential amplifiers 212, 213 and inverters 222, 232, 223, 233 similar to those mentioned above, and the outputs V2' and V3' from them are equal to the input potentials V2 and V3, respectively.

To the differential amplifier 241 at the subsequent stage, there are applied the potentials of V1' and V3', hence the output therefrom becomes a voltage difference of V1' and V3', i.e., a voltage-to-ground corresponding to the indicated voltage of Ne, so that an output voltage insulated from the Te measuring circuit can be obtained without use of the insulated coupling element. This control voltage corresponding to Te is applied to the gas control circuit 16 to adjust the electromagnetic valve 5, thereby controlling the pressure of the specimen gas, and stabilizing the plasma flame.

Since the potentials of V2' and V3' are imparted to the differential amplifier 242, the output therefrom becomes a voltage difference of V2' and V3', i.e., a voltage-to-ground corresponding to the indicated voltage of Ne, whereby it is possible to obtain an output voltage insulated from the Ne measuring circuit without use of the insulated coupling element. This control voltage corresponding to Ne is applied to the excitation power control circuit 17 to adjust the output power from the microwave power source and to control the plasma excitation power, thereby stabilizing the plasma flame.

In FIG. 2, reference numerals 191, 192, and 193 all designate resistors for preventing short-circuiting, which function to prevent, during a period until the differential amplifier circuit reaches its state of equilibrium, any mal-effect due to lowering of the input load impedance from influencing on the preceding stage. Upon equilibration, however, the input load impedance becomes high, hence this voltage drop by the resistors does not bring about any problem. Reference numerals 201, 202, and 203 designate input terminal resistors.

INDUSTRIAL APPLICATION

The plasma contains therein very wide range of factors in its instability, all of which can not be removed. However, by putting the present invention into practice, remarkable improvement in them can be expected. A fairly high degree of effect can be attained by carrying out the automatic control of the gas pressure and high frequency wave exciting power, independently, according to the present invention. If, however, both of them are controlled simultaneously, the stability of the plasma could be improved by one numerical place of its value. According to experiments, a specimen gas prepared by mixing 10% of methane gas with hydrogen gas was used under a pressure of 0.2 Torr, while imparting to it a microwave excitation power of 300 W at 2.45 GHz, to generate plasma. This operation was continued for four hours, and it could be continued very stably.

We claim:

1. A plasma stabilizing apparatus for operating a system having three probes for immersion in a plasma, the apparatus comprising:

a circuit for coupling to the three probes, for generating a first signal indicative of an electron temperature of the plasma and a second signal indicative of an electron density of the plasma;

a coupling element, having a first input responsive to the first signal, a second input responsive to the second signal, and first and second outputs electrically isolated from the first and second inputs, for generating a third signal on the first output, the third signal being indicative of the electron temperature of the plasma, and for generating a fourth signal on the second output, the fourth signal being indicative of the electron density of the plasma;

a circuit for controlling a plasma gas pressure in response to the third signal; and a circuit for controlling a plasma excitation power in response to the fourth signal.

2. A plasma stabilizing apparatus for operating a system having first, second, and third probes for immersion in a plasma, the apparatus comprising:

a circuit, for coupling to the first, second, and third probes, for generating a first signal indicative of an electron temperature of the plasma and a second signal indicative of an electron density of the plasma, the first circuit including a voltage source having an output coupled to the first probe;

a subtracting circuit for generating a third signal, responsive to the first signal and to a voltage on the output of the voltage source, indicative of the electron temperature of the plasma, and for generating a fourth signal, responsive to the second signal and to the voltage on the output of the voltage source, indicative of the electron density of the plasma, a circuit for controlling a plasma gas pressure in response to the third signal; and a circuit for controlling a plasma excitation power in response to the fourth signal.

3. The plasma stabilizing apparatus of claim 1, wherein the coupling element includes an isolation amplifier.

4. The plasma stabilizing apparatus of claim 1, wherein the coupling element includes a voltage/frequency conversion circuit.

5. The plasma stabilizing apparatus of claim 1, wherein the coupling element includes a photo-isolator.

* * * * *